United States Patent [19]

Christiansen

[11] 3,962,819

[45] June 15, 1976

[54] DOLL HEAD AND HEAD COVERING ASSEMBLY

[75] Inventor: Godtfred Kirk Christiansen, Billund, Denmark

[73] Assignee: Interlego A.G., Switzerland

[22] Filed: Feb. 10, 1975

[21] Appl. No.: 548,792

[52] U.S. Cl. ..... 46/164

[51] Int. Cl.[2] ..... A63H 3/36

[58] Field of Search ..... 46/164, 172, 116, 22, 46/142, 2; 40/106.25, 106.3

[56] References Cited

UNITED STATES PATENTS 1,558,232 10/1925 Bruckner ..... 46/164

1,572,321 2/1926 Slater ..... 46/164

*Primary Examiner*—Louis G. Mancene

*Assistant Examiner*—Jack Q. Lever

*Attorney, Agent, or Firm*—Stevens, Davis, Miller & Mosher

[57] ABSTRACT

The inside of a head gear adapted to be movably mounted on a substantially spherical doll head having a projection extending upwardly from the head is provided with a groove defined by a pair of ribs inside the cap. The top projection of the head is guided in the groove so as to enable the cap to be tilted relatively to the head between two extreme positions.

1 Claim, 4 Drawing Figures

DOLL HEAD AND HEAD COVERING ASSEMBLY

This invention relates to means for adjustably positioning a head gear such as a cap, hat or hair piece on a doll head, and the object of the invention is more particularly to provide an arrangement whereby a cap or hair piece may be movably connected with the head so as to enable it to be tilted in various positions relatively to the head without change in latch.

The invention will be described with reference to the drawings in which.

Figure 1:
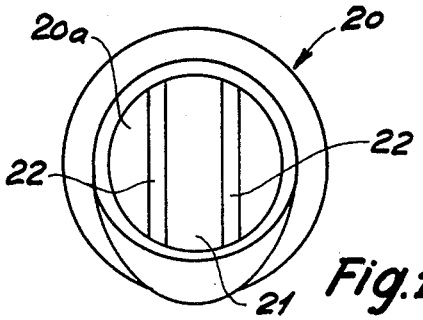
FIG. 1 is a bottom view of a cap showing the inside thereof.
Figure 2:
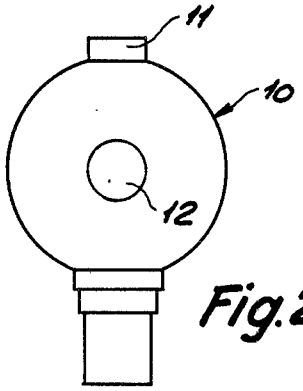
FIG. 2 is a side view of a doll head adapted to be covered with the cap of FIG. 1.

In the drawings, 10 is a substantially spherical doll head provided with a projection 11 from the top thereof and similar projections 12 at either side of the head. The head 10 comprises a neck portion adapted to be introduced into the cavity of a body portion (not shown) for mounting the head on the body of a doll.

As shown in FIG. 1 the inside 20a of a cap 20 is provided with a pair of ribs 22 defining a groove 21 therebetween, the width of the groove being substantially equal to the diameter of the projection 11.

Figure 3:
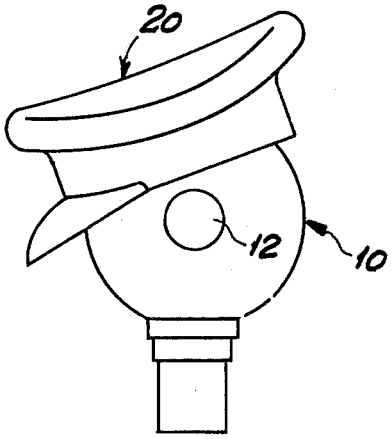
FIGS. 3 and 4 are schematic side views showing the cap mounted on the doll head in two extreme positions relatively thereto.
Figure 4:
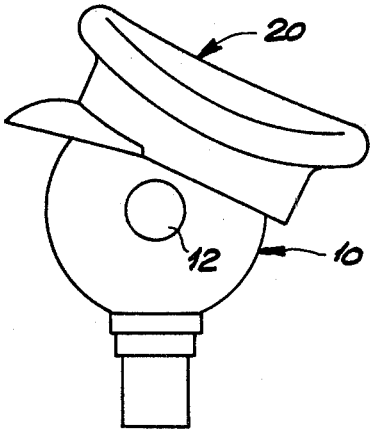

With this arrangement, the cap 20 may be assembled with the head 10 so as to be guided relatively thereto by means of the projection 11 engaging the groove 21. The cap 20 may thus be tilted relatively to the head 10 in any position between the two extreme positions shown in FIGS. 3 and 4.

What I claim is:

1. A combined doll's head and head gear assembly mounted thereon, said head being substantially spherical with a projection from the top thereof, said head gear being adapted to cover the top of said head, the interior of said head gear defining an arcuate groove of a width about equal to the transverse dimension of said projection and adapted to receive said projection, so that said gear may move in a limited guided path over the top of the head, whereby said head gear is movable into a plurality of positions over the top of said head.

* * * * *